United States Patent [19]

Davison

[11] Patent Number: 4,496,427

[45] Date of Patent: Jan. 29, 1985

[54] PREPARATION OF HYDROPHILIC POLYOLEFIN FIBERS FOR USE IN PAPERMAKING

[75] Inventor: Robert W. Davison, Wilmington, Del.

[73] Assignee: Hercules Incorporated, Wilmington, Del.

[21] Appl. No.: 112,030

[22] Filed: Jan. 14, 1980

[51] Int. Cl.[3] ..... D21H 5/12

[52] U.S. Cl. ..... 162/157.5; 162/146; 162/180; 428/394

[58] Field of Search ..... 162/157 R, 146, 182, 162/180, 168 R, 183, 157.5; 428/394; 260/29.6 RW, 27 R, 29.6 PT; 427/212, 222; 264/7

[56] References Cited

U.S. PATENT DOCUMENTS 3,743,570 7/1973 Yang et al. ..... 162/157 R

OTHER PUBLICATIONS

English Translation of German Pat. Appln. 2413922, Oct. 1974.

English Translation of Belgium Patent No. 850721.

*Primary Examiner*—Peter Chin

[57] ABSTRACT

Water-dispersible, uniformly hydrophilic polyolefin fibers are prepared by treatment of an aqueous suspension of spurted polyolefin fibers with an aqueous solution of a water-soluble ionized reagent capable of being converted into hydrated solid particles submicron in size to form a dispersion of said fibers and then adding to the dispersion an ionic precipitant for the ionized reagent. Representative of the ionized reagent and the ionic precipitant are the sodium salt of hydrogenated rosin and papermakers' alum, respectively.

7 Claims, No Drawings

PREPARATION OF HYDROPHILIC POLYOLEFIN FIBERS FOR USE IN PAPERMAKING

This invention relates to a process for the preparation of hydrophilic polyolefin fibers which are readily dispersible in water and which can be blended with wood pulp fibers to provide a pulp which can be made into high quality paper using conventional papermaking techniques. More particularly, this invention relates to formation of polyolefin-based fibers and treatment of these fibers by precipitating on the surfaces thereof a hydrated material of submicron dimensions. The presence of the hydrated material on the fiber surface renders the fiber uniformly hydrophilic and ionic.

In recent years, a considerable amount of effort has been expended in the development of water-dispersible, fibrous polyolefin pulps having hydrophilic properties. One procedure developed for the purpose of attaining such properties is that described in U.S. Pat. No. 3,743,570 to Yang et al, assigned to Crown Zellerbach Corporation. According to this patent, polyolefin fibers having a high surface area are treated with a hydrophilic colloidal polymeric additive composed of a cationic polymer such as melamine-formaldehyde and an anionic polymer such as carboxymethyl cellulose. Another procedure developed for the preparation of water-dispersible, hydrophilic polyolefin pulps has been one involving the spurting of a mixture of the polyolefin and an additive such as a hydrophilic clay or a hydrophilic polymer, for example, polyvinyl alcohol. The spurting process used in these preparations is one in which the polyolefin and the hydrophilic additive are dispersed in a liquid which is not a solvent for either component at its normal boiling point, heating the resulting dispersion at superatmospheric pressure to dissolve the polymer and any solvent-soluble additive, and then discharging the resulting composition into a zone of reduced temperature and pressure, usually atmospheric, to form the fibrous product.

A deficiency of these polyolefin pulps has been that, when they have been blended with wood pulp, the resulting paper products have exhibited considerably less strength than that of a paper prepared from wood pulp alone. However, some improvement in the strength of paper made from blends of polyolefin pulps and wood pulp has been realized by imparting an anionic character to the polyolefin pulp. For example, in their German application No. 413,922, filed Mar. 22, 1974 and published Oct. 17, 1974 as U.S. Pat. No. 2,413,922, Toray Industries, Inc. have disclosed the preparation of anionic pulps by spurting mixtures of polyolefins and copolymers of olefinic compounds with maleic anhydride or acrylic or methacrylic acids. Blends of these pulps with wood pulp have provided paper with better tensile strength than paper made without the copolymer component.

Moreover, in Belgian Pat. No. 850,721 to Hercules Incorporated, it is disclosed that paper having further improved strength properties can be prepared by forming a spurted fibrous anionic polyolefin composition containing carboxylic functionality, for example, a spurted fibrous composition comprising a mixture of a polyolefin and a carboxyl-containing anionic polymer, and then modifying this fibrous product by intimately contacting the fibers in a dilute aqueous solution or dispersion of a blend of a certain type of cationic, water-soluble, nitrogen-containing polymer and a certain type of anionic, water-soluble, nitrogen-containing polymer. The fiber modifying step results in deposition of the blend of cationic and anionic nitrogen-containing polymers on the spurted fibers, and the originally anionic fibers are converted into modified fibers which are capable of bonding to the cellulosic fibers of wood pulp.

Even so, paper prepared from blends of the aforementioned modified fibers and wood pulp, although exhibiting satisfactory strength properties, has presented, in certain instances, some difficulties associated with actual use of the paper. For example, the immediate product from a papermaking machine is a roll of paper of such size that the paper normally has to be cut into specified widths and rewound in order to be placed in usable form. During the rewinding operation, the paper is passed at high speed, normally over stationary metal guides, and the resulting heat and friction cause embrittlement and flaking off of certain types of the modified polyolefin fibers in the form of dust. Much of this dust is carried along with the paper and, when the paper is used, for example, in offset printing, the dust accumulates on the ink roll, necessitating frequent cleaning to insure proper transfer of the ink to the printing roll.

Now in accordance with this invention, it has been found that a paper having satisfactory strength properties and improved rewindability and printability can be prepared by forming an aqueous suspension of spurted polyolefin fibers, adding to said suspension an aqueous solution of a water-soluble ionized reagent capable of being converted into hydrated solid particles submicron in size and then adding to the resulting dispersion an ionic precipitant for said reagent, thereby effecting precipitation of said hydrated solid particles uniformly onto the surfaces of the polyolefin fibers. Thus, the fiber surfaces become essentially uniformly hydrophilic and ionic. As a consequence, the treated fibers are hydrophilic, water-dispersible and very receptive to hydrophilic additives, such as starch, which are ordinarily added in the papermaking process. The preferred water-soluble ionized reagents of this invention are the alkali metal salts of rosin and modified rosins.

As an example of the process of this invention, spurted polypropylene fibers are suspended in water by stirring and to the stirred suspension is added a dilute aqueous solution of the sodium salt of rosin. Stirring is continued and then a dilute aqueous solution of alum is added to the fiber dispersion, resulting in deposition of hydrated rosin-containing particles submicron in size on the surface of the polypropylene fibers. The treated fibers may then be isolated and stored in wet cake form, or the suspension containing the fibers may be used directly in a papermaking process.

Having generally outlined the embodiments of this invention, the following examples illustrate various embodiments thereof. All amounts and percentages are by weight unless otherwise specified.

EXAMPLE A

A cationic, water-soluble, nitrogen-containing polymer was prepared from diethylenetriamine, adipic acid and epichlorohydrin. Diethylenetriamine in the amount of 0.97 mole was added to a reaction vessel equipped with a mechanical stirrer, a thermometer and a reflux condenser. There then was gradually added to the reaction vessel one mole of adipic acid with stirring. After the acid had dissolved in the amine, the reaction mixture was heated to 170°–175° C. and help at that temperature for one and one-half hours, at which time the reaction mixture had become very viscous. The reaction mixture then was cooled to 140° C., and sufficient water was added to provide the resulting polyamide solution with a solids content of about 50%. A sample of the polyamide isolated from this solution was found to have a reduced specific viscosity of 0.155 deciliters per gram when measured at a concentration of two percent in a one molar aqueous solution of ammonium chloride. The polyamide solution was diluted to 13.5% solids and heated to 40° C., and epichlorohydrin was slowly added in an amount corresponding to 1.32 moles per mole of secondary amine in the polyamide. The reaction mixture then was heated at a temperature between 70° and 75° C. until it attained a Gardner viscosity of E-F. Sufficient water next was added to provide a solids content of about 12.5%, and the solution was cooled to 25° C. The pH of the solution then was adjusted to 4.7 with concentrated sulfuric acid. The final product contained 12.5% solids and had a Gardner viscosity of B-C.

EXAMPLE B

An anionic, water-soluble, nitrogen-containing polymer was prepared from acrylamide, acrylic acid and glyoxal. To a reaction vessel equipped with a mechanical stirrer, a thermometer, a reflux condenser and a nitrogen adapter was added 890 parts of water. There then was dissolved in the water 98 parts of acrylamide, two parts of acrylic acid and one and one-half parts of aqueous 10% cupric sulfate. The resulting solution was sparged with nitrogen and heated to 76° C., at which point two parts of ammonium persulfate dissolved in six and one-half parts of water was added. The temperature of the reaction mixture increased 21.5° C. over a period of three minutes following addition of the persulfate. When the temperature returned to 76° C., it was maintained there for two hours, after which the reaction mixture was cooled to room temperature. The resulting solution had a Brookfield viscosity of 54 centipoises at 21° C. and contained less than 0.2% acrylamide based on the polymer content.

To 766.9 parts of the above solution (76.7 parts of polymer containing 75.2 parts, or 1.06 mole, of amide repeat units) was added 39.1 parts of aqueous 40% gloxal (15.64 parts, or 0.255 equivalent based on amide repeat units, of glyoxal). The pH of the resulting solution was adjusted to 9.25 by the addition of 111.3 parts of aqueous 2% sodium hydroxide. Within approximately 20 minutes after addition of the sodium hydroxide, the Gardner viscosity of the solution had increased from A to E. The reaction was then terminated by the addition of 2777 parts of water and about two and six-tenths parts of aqueous 40% sulfuric acid. The resulting solution had a pH of 4.4 and contained 2.2% solids.

EXAMPLE 1

Fifteen grams of air-dried spurted polypropylene was placed in a one-gallon Waring blender together with 1.3 liters of demineralized water and the mixture was stirred moderately. To the resulting suspension there was added three percent (based on dry fiber weight) of a completely hydrogenated rosin size (completely saponified) as an aqueous solution, with continued stirring, and there then was added sufficient 10% papermakers' alum solution to reduce the system pH to about 4.1. The resulting dispersion then was stirred at full blender speed for one minute, after which it was diluted to 1.5 liters. This procedure was repeated with another 15-gram fiber sample, and the two preparations were combined.

In making handsheets using the treated polypropylene fibers, 1.26 liters of the combined slurry described above was partly dewatered by filtration and then added to 1.18 liters of a 2.5% wood pulp slurry (29.4 grams of dry fiber consisting of 50% softwood bleached kraft and 50% hardwood bleached kraft) which had been beaten to 750 ml. Schopper-Riegler freeness in a Noble and Wood cycle beater, using neutral tap water as the aqueous phase. Forty-pound/3000 sq. ft. (basis weight) handsheets were made from this 30% polypropylene/70% wood pulp fiber blend using Noble and Wood handsheet equipment. The formed sheets were wet pressed and then dried by two passes over a 240°–250° F. drum dryer.

EXAMPLE 2

Polypropylene fibers were treated as in Example 1 except for the use of one percent (based on dry fiber weight) of a wood rosin size which contained excess alkali in place of the hydrogenated rosin size of Example 1. In making handsheets using these fibers, 1.26 liters of slurry was first stirred in the presence of 0.63 gram of a bonding agent which was a 1:5 by weight blend of the cationic polymer of Example A and the anionic polymer of Example B. The resulting slurry was then partly dewatered before combining with the standard wood pulp slurry as in Example 1. Handsheets were made in the same manner as in Example 1.

EXAMPLE 3

The procedure of Example 2 was duplicated except that three percent wood rosin size was added instead of one percent.

EXAMPLE 4

The procedure of Example 3 was repeated with the exception that three percent hydrogenated rosin size of the type used in Example 1 was used instead of three percent wood rosin size.

Handsheet properties for Examples 1 to 4 are listed in Table I. The data for Example 1 show that adequate sheet dry strength values were obtained. The data for Examples 2 to 4 show the increased strength values obtained by addition of the bonding agent of Example 2, thus demonstrating that the treated fibers are quite responsive to the bonding agent.

TABLE I

| | | | | Dry Strength | | | |
|---|---|---|---|---|---|---|---|
| Ex. | Caliper (mils) | Brightness (%) | Opacity (%) | Mullen Burst (psi) | Instron Tensile (lb./in.) | MIT Fold | Bonding Agent in Sheet (%)* |
| 1 | 8.3 | 92.0 | 92.0 | 15.7 | 10.6 | 15 | 0 |
| 2 | 7.8 | 90.6 | 91.9 | 17.5 | 11.5 | 29 | 6.0 |
| 3 | 8.0 | 90.1 | 90.9 | 19.7 | 12.3 | 33 | 4.5 |
| 4 | 7.8 | 90.8 | 91.2 | 20.1 | 12.9 | 33 | 6.1 |

*The % bonding agent in the sheet is based on the amount of the polypropylene fiber component.

Results comparable to those of the above examples were obtained when the alkali metal salts of partially hydrogenated rosin, disproportionated rosin, dimerized rosin, polymerized rosin, fumaric acid-modified rosin and ethylene-acrylic acid copolymer were used in place of the rosin and completely hydrogenated rosin sizes of the examples.

EXAMPLE 5

The synthetic pulp used in this example was prepared by first dissolving a 99.5:0.5 mixture of polypropylene (IV=1.9-2.2) and octadecyl 3-[3,5-di(tertiary butyl)-4-hydroxyphenyl]propionate stabilizer in 98:2 hexane:water to eight percent polymer solids at 215° C. and 80 kg/cm$^2$ pressure. The resulting solution was released through a nozzle into a region of autogenous pressure at 80° C. and the pulp (surface area=3.6 m$^2$/gm.; monoclinic crystallinity) that formed was carried into an aqueous solution of poly(vinyl alcohol). The poly(vinyl alcohol) (PVA) had a degree of hydrolysis >98% and a minimum viscosity, measured on a four percent aqueous solution at 20° C., of four centipoises. The PVA was affixed to the fiber in an amount of about one-half percent by deflaking the pulp suspension in the aqueous PVA solution.

After dewatering and baling, the synthetic pulp wet mat was transported to appropriate papermaking equipment where 50 dry pounds was suspended in soft water at two to two and one-half percent consistency in a beater. To this pulp slurry was added an aqueous solution of sodium resinate formed by dissolving two dry pounds of N-wood rosin in aqueous sodium hydroxide (102 dry grams of NaOH), stirring at 80° C. until the rosin was completely dissolved, and then diluting to five percent rosin solids. The percent rosin based on the synthetic pulp was four percent, calculated as free acid. Then, 26 pounds of 12% aqueous alum (3.12 dry lb., 6.24% based on the synthetic pulp) was added to the beater, the final pH being 4.4. After the mixture was stirred 10–15 minutes, the pH was increased to 7.4 by addition of two and one-half liters of aqueous five percent NaOH, after which 42 pounds of six percent cationic starch (Sta-Lok 400, two and one-half dry pounds, five percent based on the synthetic pulp) was added.

Wood pulp (50 dry pounds of Weyerhauser bleached hardwood kraft, WBHK, and 100 dry pounds of Rayonier bleached softwood kraft, RBSK) was defibered in the beater containing the treated synthetic pulp; the percent synthetic pulp was 25% of the total pulp furnish. The pulp blend was refined to 286 Canadian Standard Freeness (CSF), first with a Claflin refiner and then with a double disc refiner. After internal addition of 0.35% of fortified free rosin emulsion (Neuphor 100) and 1.25% alum to the dilute pulp slurry for sizing, it was formed into a sheet on a conventional Fourdrinier paper machine. A mixture of an aqueous six percent cationic starch (Cato 67) solution and an aqueous sixtenths percent cationic wet-strength resin (Kymene ®557) solution was added at the size press. Light calendering was applied before the sheet was rolled up. The following physical test data were obtained after the paper was aged for several weeks: basis weight=26.2 lb./3000 ft.$^2$; caliper=3.0 mils; Tappi brightness=86.6%; Tappi opacity=71.4%; Mullen burst=12.6 p.s.i.; tensile=12.1 lb./1 in. width; MIT fold=92; IGT pick, VVP=108 KP-cm./sec.

Rewindability was tested on a small rewinder. The paper was judged to run clean at 1500 ft./min. and gave a small but acceptable amount of dust at 1850 ft./min. For comparison, paper containing an oxidized polypropylene pulp treated in accordance with Belgian Pat. No. 850,721 rarely ran clean at 800 ft./min. and never rewound with an acceptable amount of dust at 1200 ft./min.

The paper which had been rewound at 1500 ft./min. was sheeted and then printed using a sheet-fed offset printing press. Print quality was judged to be good, and no dust and only a very small amount of lint were found on the offset blanket. For comparison, paper prepared in the same way as in this example except for omission of the sodium resinate-alum treatment displayed very poor print quality and gave an excessive amount of debris and lint on the offset blanket.

EXAMPLE 6

The same synthetic pulp used in Example 5 was pretreated with N-wood rosin size and alum, prior to use in the papermaking operation, by first dispersing 50 dry pounds of the PVA-containing pulp in 600 gallons deionized water and then adding an aqueous solution of two dry pounds (four percent based on the synthetic pulp) N-wood rosin dissolved in aqueous alkali as described in the previous example. This mixture was stirred for 15 minutes and then treated with six percent (based on the synthetic pulp) alum (three dry pounds in two gallons of water). After vigorous stirring for 30 minutes, the resulting slurry (pH about 4.5) was dewatered in large filter crocks to give a pulp mat, at about 20% solids, which was transported to appropriate papermaking equipment. It then was dispersed in soft water and to the resulting slurry (pH 7.4) was added 42 pounds of an aqueous six percent solution of Sta-Lok 400 (two and one-half dry pounds, five percent based on the synthetic pulp), followed by 50 dry pounds of WBHK and 100 dry pounds of RBSK pulp. The pulp blend was refined to 348 CSF and then made into paper as described in Example 5.

The calendered sheet gave the following test data after natural aging: basis weight=28.9 lb./3000 ft.$^2$; caliper=3.6 mils; Tappi brightness=86.0%; Tappi opacity=73.0%; Mullen burst=13.6 p.s.i.; tensile=13.5 lb./1 in. width; MIT fold=110; IGT pick, VVP=66 KP-cm./sec. Rewindability and printability of the paper prepared in this example were essentially equivalent to those of the paper of Example 5.

EXAMPLE 7

Using the same synthetic pulp as that of Example 5 and following substantially the procedure of Example 5 except for minor variations in amounts of materials used, the pulp was treated with the sodium salt of a partially hydrogenated wood rosin instead of the sodium salt of the N-wood rosin of Example 5. In so doing, 40 dry pounds of the pulp, dispersed in water, was treated with an aqueous solution formed by dissolving two and four-tenths pounds of the partially hydrogenated rosin in aqueous sodium hydroxide containing 135 dry grams of NaOH, and then diluting the solution to 12% solids. The percent hydrogenated rosin based on the synthetic pulp was six percent, calculated as free acid.

To the resulting dispersion was added ten pounds of 12% aqueous alum, the pH was adjusted from 4.6 to 6.8, a six percent cationic starch solution was added in the amount of 33 pounds, wood pulp (40 pounds WBHK and 80 pounds RBSK) was added, the pulp blend was refined to 335 CSF and then the blend was made into paper as in Example 5 except to omit addition of the wet-strength resin at the size press. After aging, the following test data were obtained: basis weight=29.2 lb./3000 ft.$^2$; caliper=3.6 mils; Tappi brightness=87.5%; Tappi opacity=73.8%; Mullen burst=13.3 p.s.i.; tensile=14.1 lb./1 in. width; MIT fold=110; IGT pick, VVP=78 KP-cm./sec.

In the rewindability test, the paper gave a slight amount of fine powder on the spreader bar at 1240 and 1600 ft./min., and it was concluded that the paper could be rewound without difficulty at these speeds. After the rewound paper had been sheeted and trimmed, it was evaluated for printability as in Example 5. Print quality was judged to be good, and only a small amount of fine debris transferred to the offset blanket during the making of 500 impressions. It was concluded that, in comparison to a paper which had been prepared in the same way except for omission of the hydrogenated rosin-alum treatment, the paper of this example would provide at least five times as many impressions before print quality became affected by offset blanket contamination.

EXAMPLE 8

The procedure of Example 7 was essentially repeated except that no cationic starch was added following the hydrogenated rosin-alum treatment. The following test data were obtained after the paper was aged for several weeks: basis weight=28.5 lb./3000 ft.$^2$; caliper=3.4 mils; Tappi brightness=87.1%; Tappi opacity=77.9%; Mullen burst=12.8 p.s.i.; tensile=13.4 lb./1 in. width; MIT fold=130; IGT pick, VVP=97 KP-cm./sec. A roll of the paper product was rewound without difficulty at 1220 ft./min. When paper from this roll was printed, as described in Example 5, a noticeable amount of fine debris was transferred to the offset blanket. It was concluded that, in comparison to a paper which had been prepared in the same way except for omission of the hydrogenated rosin-alum treatment, the paper of this example would provide four times as many impressions before print quality became affected by offset blanket contamination. Thus, not adding cationic starch internally moderately reduced the printability of this paper product in comparison to the product of Example 7.

EXAMPLE 9

The procedure of Example 7 was substantially duplicated except that the sodium salt of the partially hydrogenated wood rosin was replaced with the sodium salt of the modified rosin formed by reaction of rosin with fumaric acid and composed of a mixture of rosin and the rosin-fumaric acid adduct (about 85% of the acid groups of the modified rosin being neutralized with sodium hydroxide). The physical properties and the rewindability and printability of the paper product were quite comparable to the corresponding properties of the product of Example 7.

EXAMPLE 10

The synthetic pulp used in this example was prepared in the same way as that of Example 5 except that tetrakis-[methylene 3-(3,5-ditertiarybutyl-4-hydroxyphenyl)propionate]-methane was used as the stabilizer and the pulp was not carried into an aqueous solution of poly(vinyl alcohol). Instead, after release into a region of autogenous pressure at 80° C., it was withdrawn through a water seal and then baled and transported to appropriate papermaking equipment. To a Hollander beater containing 300 gallons of soft water was added eight pounds of a five percent solution of sodium hydroxide. The pH of the resulting solution was 10, and to this solution then was added 12.5 pounds of a 20% solution of the ammonium salt of an ethylene-acrylic acid copolymer (20% acrylic acid, molecular weight approximately 25,000), followed by 50 dry pounds of the synthetic pulp.

The pulp was dispersed by circulating it in the beater for five minutes, following which the copolymer was precipitated in situ by the addition of 27 pounds of a five percent sulfuric acid solution to the beater, this reducing the pH to 6.2. The resulting mixture was circulated in the beater for five minutes, after which forty-two pounds of a six percent solution of cationic starch (Sta-Lok 400, five percent based on the synthetic pulp) was added and allowed to mix for a further five minutes, when 150 dry pounds of cellulose wood pulp (50 pounds of Weyerhauser bleached hardwood kraft pulp, plus 100 pounds of Rayonier bleached softwood kraft pulp) was added, together with enough soft water to adjust the consistency to approximately five percent.

The mixture was circulated through a Claflin refiner to reduce the Canadian Standard Freeness to 507, then diluted to 1.8% consistency and pumped once through a double disc refiner to reduce the Canadian Standard Freeness to 332. After internal addition of 0.35%, dry basis, fortified free rosin emulsion (Neuphor 100) precipitated in situ by 1.25% alum at pH 5.5 for internal sizing, the dilute slurry was formed into a continuous web on a conventional Fourdrinier paper machine. The web was dried by passing it over steam heated drying cylinders, surface sized with a six percent solution of cationic starch (Cato 67), redried in the normal manner, passed through three nips of a conventional calender stack, at successive pressures of 50, 100 and 150 p.l.i., and collected on a roll. After aging for several weeks, the paper gave the following test results: basis weight=31.7 lb./3000 ft.$^2$; caliper=4.0 mils; Tappi brightness=88.7%; Tappi opacity=79.2%; Mullen burst=13.2 p.s.i.; tensile=14.2 lb./1 in. width; MIT fold=76. Rewindability and printability of the paper prepared in this example were essentially equivalent to those of the paper of Example 7.

EXAMPLE 11

Using the same synthetic pulp as that of Example 10 and following substantially the procedure of that example except to form in the beater, prior to the synthetic pulp addition, a solution of the sodium salt of a partially hydrogenated rosin (six percent hydrogenated rosin based on the synthetic pulp) and to precipitate the hydrogenated rosin by the addition of an aqueous solution of calcium nitrate (six percent calcium nitrate based on the synthetic pulp). The paper product, after aging, had the following properties: basis weight=30.6 lb./3000 ft.$^2$; caliper=3.7 mils; Tappi brightness=87.9%; Tappi opacity=78.8%; Mullen burst=13.7 p.s.i.; tensile=14.3 lb./1 in. width; MIT fold=73; IGT pick, VVP=97 KP-cm./sec. Rewindability and printability of the paper product were essentially equivalent to those of the paper of Example 7.

In the above examples, the physical property data were obtained in accordance with standard test procedures. They are as follows: caliper, Tappi 411; brightness, Tappi 452; opacity, Tappi 425; Mullen burst, Tappi 403; MIT fold, Tappi 511; and IGT pick, Tappi 499. The dry tensile strength was determined on an Instron tensile tester using a one-inch wide strip and a constant rate of elongation.

As is apparent from the examples, any rosin, modified rosin, ethylene-acrylic acid copolymer or ethylene-methacrylic acid copolymer in the form of its alkali metal or ammonium salt may be used as the water-soluble ionized reagent capable of being converted into hydrated solid particles submicron in size in accordance with the process of this invention. Mixtures of these alkali metal and ammonium salts may also be used. Ordinarily, these salts are formed by complete or substantially complete neutralization of the corresponding acidic materials. Sodium hydroxide is the preferred base used in preparation of the salts, although potassium, lithium and ammonium hydroxides may also be used. The amount of alkali metal or ammonium salt may be varied from about one to about 10% by weight, based on the amount of polyolefin fibers, but preferably is in the range of from about two to about six percent, more preferably from about three to about five percent. Both wood and gum rosins, and also tall oil rosin, may be used as sources of the rosin and modified rosins. The ethylene-acrylic acid and ethylene-methacrylic acid copolymers useful in accordance with this invention are those copolymers having a melt index of from about 50 to about 600, preferably from about 300 to about 400, and containing from about 10 to about 40%, preferably from about 15 to about 30%, by weight of acrylic acid- or methacrylic acid-derived units.

In those examples wherein the water-soluble ionized reagent is an alkali metal salt of rosin or a modified rosin, the ionic precipitant ordinarily used was papermakers' alum, namely, hydrated aluminum sulfate (usually 14 to 18 molecules of water of hydration). The amount of alum generally is about 0.75 to about 1.5 times the weight of the rosin or modified rosin salt. However, it also is possible to use water-soluble calcium and magnesium salts, such as the nitrates, bromides and chlorides, blends of alum and sulfuric acid and sulfuric acid alone. Any of these ionic precipitants may also be used with the alkali metal and ammonium salts of the ethylene-acrylic acid and ethylene-methacrylic acid copolymers. However, the preferred precipitant for the copolymer salts is sulfuric acid.

As shown in Table I, the addition of a bonding agent improved the strength values of the paper products. Such bonding agents are disclosed in the Belgian Pat. No. 850,721, to Hercules Incorporated mentioned earlier. In general, the addition of a cationic wet strength resin in the preparation of paper using the hydrophilic polyolefin fibers of this invention provides improved strength properties to the paper, particularly in the case wherein the water-soluble ionized reagent is an alkali metal or ammonium salt of an ethylene-acrylic acid or ethylene-methacrylic acid copolymer. In that case, the Mullen burst and tensile strength properties may be increased by as much as 10 to 50% by inclusion of a cationic wet strength resin, which is conveniently added in the form of an aqueous solution to the beater containing the treated polyolefin fibers, the amount of said resin added usually being from about two to about eight percent, preferably from about four to about six percent, by weight, based on the amount of polyolefin fibers. Typical wet strength resins are those cationic polymers disclosed by the aforementioned Belgian patent, which polymers may generally be classified as the reaction products of epichlorohydrin and a polymer containing secondary or tertiary amine groups, or both.

The polyolefin fibers shown in the examples are spurted polypropylene fibers. However, the process of this invention is applicable to spurted fibers prepared not only from polypropylene, but also from polyethylene, copolymers of ethylene and propylene, copolymers of propylene and other 1-olefins such as 1-butene, 4-methyl-pentene-1 and 1-hexene, and mixtures of any of these polymers.

The process of this invention makes possible the preparation of improved paper products from blends of wood pulp (generally 70–90% of the blend) and polyolefin pulps (generally 10–30% of the blend). The treated polyolefin fibers are receptive to added bonding agents such as starch, and the paper products based on these treated fibers have improved brightness, opacity and printability, as well as very acceptable rewindability.

What I claim and desire to protect by Letters Patent is:

1. A process for the preparation of water-dispersible, uniformly hydrophilic polyolefin fibers which comprises forming an aqueous suspension of spurted polyolefin fibers, adding to said suspension, with stirring, an aqueous solution of a water-soluble ionized reagent capable of being converted into hydrated particles submicron in size, said ionized reagent being selected from the group consisting of the alkali metal and ammonium salts of rosin and modified rosins and mixtures thereof, and then adding to the fiber dispersion so formed an inorganic ionic precipitant for said ionized reagent, said inorganic ionic precipitant being selected from the group consisting of alum, sulfuric acid, blends of alum and sulfuric acid, and water-soluble calcium and magnesium salts, thereby effecting precipitation of said hydrated solid particles onto the surface of the polyolefin fibers.

2. The process of claim 1 wherein the water-soluble ionized reagent is an alkali metal salt of rosin or a modified rosin.

3. The process of claim 2 wherein the inorganic ionic precipitant is alum.

4. The process of claim 2 wherein the inorganic ionic precipitant is a water-soluble calcium or magnesium salt.

5. The process of claim 1 wherein the spurted polyolefin fibers are polypropylene fibers.

6. The polyolefin fibers produced by the process of claim 1.

7. A paper product containing the polyolefin fibers of claim 6.

* * * * *